US006983578B1

(12) United States Patent
Suda et al.

(10) Patent No.: US 6,983,578 B1
(45) Date of Patent: Jan. 10, 2006

(54) APPARATUS AND METHOD FOR BAGGING AN ITEM

(75) Inventors: David Suda, Warrington, PA (US); Larry Clevenstine, Trevose, PA (US); Bruce Rofsky, Lafayette Hills, PA (US)

(73) Assignee: CertainTeed Corporation, Valley Forge, PA (US)

( * ) Notice: Subject to any disclaimer, the term of this patent is extended or adjusted under 35 U.S.C. 154(b) by 281 days.

(21) Appl. No.: 09/584,182

(22) Filed: May 31, 2000

(51) Int. Cl.
*B65B 3/24* (2006.01)

(52) U.S. Cl. ..... 53/475; 53/430; 53/473; 53/576

(58) Field of Classification Search ..... 53/473, 53/475, 136.2, 576, 211, 216, 217, 430, 574, 53/575, 469
See application file for complete search history.

(56) References Cited

U.S. PATENT DOCUMENTS

| | | | | |
|---|---|---|---|---|
| 437,554 | A | | 9/1890 | Bellamy |
| 3,658,273 | A | | 4/1972 | Clapius |
| 3,717,973 | A | | 2/1973 | Brady, Jr. |
| 3,971,525 | A | | 7/1976 | Winslow |
| 4,198,010 | A | | 4/1980 | Knapp |
| 4,265,414 | A | | 5/1981 | Spradling |
| 5,020,302 | A | * | 6/1991 | Buchman et al. ..... 53/430 |
| 5,177,935 | A | | 1/1993 | Jones et al. |
| 5,799,467 | A | | 9/1998 | Nankervis et al. |
| 5,870,885 | A | * | 2/1999 | Biddle et al. ..... 53/436 |
| 5,934,041 | A | | 8/1999 | Rudolf et al. |
| 5,961,061 | A | | 10/1999 | Stanley |
| 6,093,378 | A | | 8/2000 | Wyatt |

FOREIGN PATENT DOCUMENTS

| | | |
|---|---|---|
| CA | 522772 | 3/1956 |
| GB | 448519 | 6/1936 |
| GB | 2 140 765 | 12/1984 |
| GB | 2 265 350 | 9/1993 |

* cited by examiner

*Primary Examiner*—Stephen F. Gerrity
*Assistant Examiner*—Christopher Harmon
(74) *Attorney, Agent, or Firm*—Oblon, Spivak, McClelland, Maier & Neustadt, P.C.

(57) ABSTRACT

A bagging apparatus including a main portion having a tube section and a flared section with a wide opening. The apparatus preferably includes a device configured to mount the apparatus on a stationary structure, and a receptacle configured to fit over a receptacle receiving portion on an exterior surface of the tube section adjacent an opening thereof. A method is provided that allows for the insertion of an item into a receptacle using the bagging apparatus. The method includes the step of positioning a receptacle over an exterior surface of the tube section adjacent an opening thereof. The item is inserted within the flared section of the bagging apparatus via the wide opening. The item is then slid through a narrow opening of the flared section, through the tube section, and within the receptacle. The method further includes the step of aligning the item at a predetermined orientation within the receptacle.

7 Claims, 4 Drawing Sheets

APPARATUS AND METHOD FOR BAGGING AN ITEM

BACKGROUND OF THE INVENTION

1. Field of the Invention

The present invention relates generally to an apparatus and method for inserting an item into a receptacle.

2. Discussion of the Background

In various steps of a manufacturing process it may be necessary to insert an item into a receptacle. For example, during the packaging phase the item might require insertion within a receptacle, such as a flexible sleeve or bag, in order to seal the item for shipping and for sale to the consumer. In some instances the item may be difficult to insert within the receptacle, for example, where the item is sized to fit tightly within the receptacle, where the item has edges that tend to catch on the opening of the receptacle, or where the material will expand when pressure is not applied to prevent the expansion. In such instances the process of inserting the item within the receptacle is a labor intensive process which may require more than one worker in order to successfully package the item.

Additionally, the aesthetics of the final packaged product is important, since the ultimate consumer will take the aesthetics of the final product into account during the process of deciding which product among several competing products the consumer wishes to purchase. The aesthetics of the final packaged product can, therefore, has a significant impact on the success of a product in the marketplace. Especially, when an item is packaged within a transparent packaging material. Therefore, if the item is forced into the receptacle and the product becomes damaged or appears deformed within the packaging, the consumer may decide not to purchase that product, and may opt for a competing product.

Based upon the above observations by the inventors of the present invention, the inventors have determined that an apparatus and method for inserting an item within a receptacle is needed that will overcome the disadvantages discussed above.

SUMMARY OF THE INVENTION

An object of the present invention is to provide an apparatus and method for inserting an item into a receptacle with ease and in a manner that is not labor intensive.

Another object of the present invention is to provide an apparatus and method for inserting an item into a receptacle without fraying, bending, or otherwise damaging the item. The apparatus and method should provide for the neat insertion of the item into the receptacle to produce a final product that is aesthetically pleasing to the consumer.

The present invention advantageously provides a bagging apparatus that includes a main portion having a tube section and a flared section. The bagging apparatus preferably includes a device configured to mount the apparatus on a stationary structure. A preferred embodiment of the mounting device includes a base, and a bracket connecting the base to the main portion. The apparatus preferably further includes a receptacle configured to fit over an exterior surface of the tube section adjacent an opening.

The tube section is generally hollow and has a first opening connected to the flared section, and a second opening generally configured to open into the receptacle when a receptacle is positioned on a receptacle receiving portion on the exterior surface of the tube section adjacent the second opening. The flared section is generally hollow and has a wide opening generally configured to receive an item, and a narrow opening connected to the tube section. The flared section is preferably formed in a truncated, conical shape, however other shapes can be used. The shape and size of the tube section and the flared section generally depend upon the shape of the item being inserted within the apparatus, the shape of the receptacle, and the shape of the adjoining openings of the tube and flared sections. Preferably, the interior surface of the tube section and the interior surface of the flared section are smooth to allow the item to slide easily through the main portion.

The bagging apparatus according to the present invention preferably includes a mounting device configured to mount the apparatus on a stationary structure, such as a table, a wall, the ground, a flat surface, or any other suitable structure. The bagging apparatus preferably further includes a receptacle configured to fit over the receptacle receiving portion on the tube section. The preferred embodiment of the receptacle is a transparent plastic bag having indicia thereon labeling the product, which can be used also as a reference for orienting and aligning the item within the receptacle in order to ensure the final product is aesthetically pleasing to the consumer.

The present invention advantageously provides a method for inserting an item into a receptacle using a bagging apparatus. The method for inserting an item into a receptacle is advantageous in that it provides a process for easily and neatly inserting an item into a receptacle. The method includes the step of positioning a receptacle over an exterior surface of the tube section adjacent the second opening. The item being inserted within the bagging apparatus can be of any configuration, however, the item is preferably an elongated sheet of material and the receptacle is a transparent plastic bag. The sheet of material is preferably rolled prior to insertion into the bagging apparatus. The rolled sheet of material is inserted within the flared section of the bagging apparatus via the wide opening. Preferably the rolled sheet of material is inserted within the flared section while rotating the sheet of material in a direction opposite the direction that the rolled sheet of material is rolled during formation of the rolled sheet of material, such that an exterior terminal edge of the rolled sheet of material is maintained flat against the exterior surface of the rolled sheet of material. By using this method, the final product will be aesthetically pleasing to a consumer, since the rolled sheet of material will be neatly inserted into the receptacle without any frayed or deformed edges. The rolled sheet of material is then slid through the narrow opening of the flared section, through the tube section, and within the receptacle. In order to produce a product that is aesthetically pleasing to a consumer, the method further includes the step of aligning the rolled sheet of material at a predetermined orientation within the receptacle. This can be carried out by either rotating the rolled sheet of material while it is in the tube section or while it is in the receptacle. The rolled sheet of material can be oriented at a predetermined orientation, for example, by orienting the exterior terminal edge at a predetermined position with respect to the indicia on the receptacle. For example, by placing the exterior terminal edge at the rear of the receptacle, the consumer will view a smooth surface of the rolled sheet of material on the front of the receptacle where the labeling indicia is present. Once the rolled sheet of material is positioned within the receptacle, the open end can be sealed to form the final product.

BRIEF DESCRIPTION OF THF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
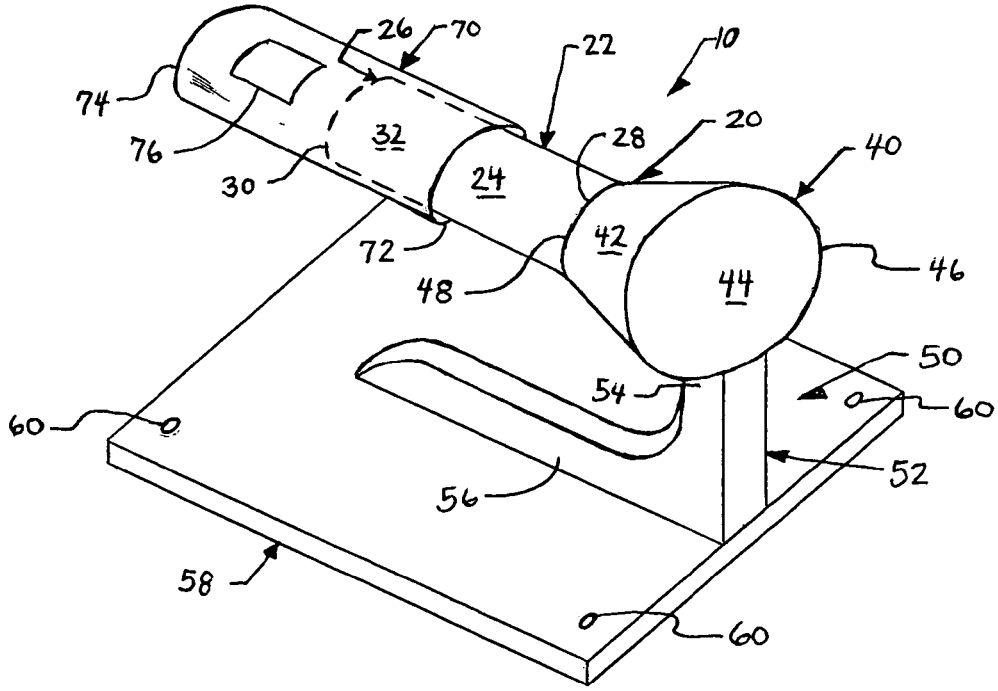
FIG. 1 is a perspective view of an embodiment of a bagging apparatus according to the present invention.
Figure 2:
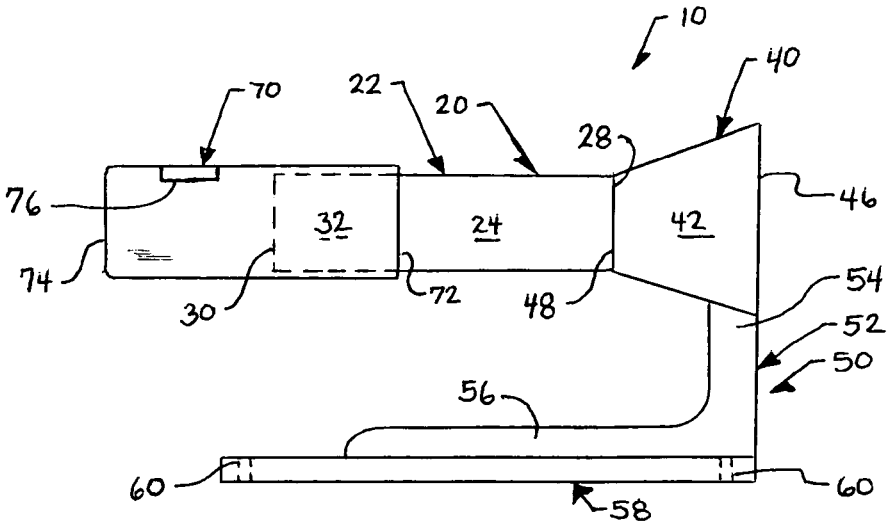
FIG. 2 is a side view of an embodiment of a bagging apparatus according to the present invention.
Figure 3:
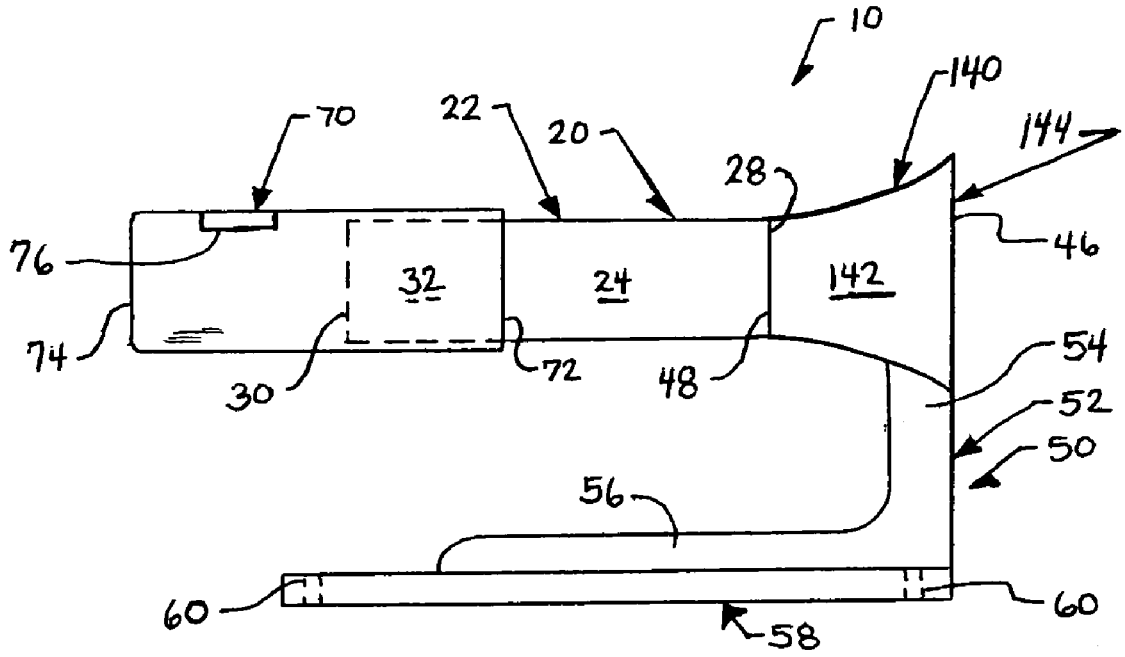
FIG. 3 is a side view of an alternative embodiment of a bagging apparatus according to the present invention.

Referring now to the drawings, where like reference numerals identify the same or corresponding parts throughout the several views, FIGS. 1 through 3 depict various embodiments of a bagging apparatus according to the present invention. Additionally, FIGS. 4A through 4D set forth a method of bagging an item according to the present invention.

FIGS. 1 and 2 depict an embodiment of a bagging apparatus 10 according to the present invention. The apparatus 10 generally includes a main portion 20 having a tube section 22 and a flared section 40. The bagging apparatus 10 preferably includes a device configured to mount the apparatus on a stationary structure. A preferred embodiment of the mounting device 50 includes a base 58, and a bracket 52 connecting the base 58 to the main portion 20, such as to the tube section 22 or, alternatively, to the flared section 40. The apparatus preferably further includes a receptacle 70 configured to fit over an exterior surface 24 of the tube section 22 adjacent an opening 30.

The tube section 22 is generally hollow with an exterior surface 24 and an interior surface 26. The tube section 22 has a first opening 28 at one end thereof and a second opening 30 at an opposite end thereof. The first opening 28 is connected to the flared section 40, while the second opening 30 is generally configured to open into the receptacle 70 when a receptacle is positioned on a receptacle receiving portion 32 on the exterior surface 24 of the tube section 22 adjacent the second opening 30. The tube section 22 is preferably cylindrical in shape with a circular cross-section, however other shapes can be used. For example, the tube section 22 can be formed having a cross-section shape of any type of polygon, or any type of rounded shape, such as oval, elliptical, or any other rounded shape. Additionally, the tube section 22 can be formed such that the cross-sectional shape and/or cross-sectional area varies along the length of the tube section 22 or maintains a constant cross-section shape and/or cross-sectional area along the length of the tube section 22, or a portion of the length thereof. The shape and size of the tube section 22 generally depends upon the shape of the item being inserted within the tube section 22 and the shape of the receptacle.

The flared section 40 is generally hollow with an exterior surface 42 and an interior surface 44. The flared section 40 has a wide opening 46 at one end thereof and a narrow opening 48 at an opposite end thereof. The wide opening 46 is generally configured to receive an item, while the narrow opening 48 is connected to the tube section 22. The flared section 40 is preferably formed in a truncated, conical shape, however other shapes can be used. For example, the flared section 40 can be formed having a cross-section shape of any type of polygon, or any type of rounded shape, such as oval, elliptical, or any other rounded shape. Additionally, the flared section 40 can be formed such that the cross-sectional shape and/or cross-sectional area varies along the length of the flared section 40 or maintains a constant cross-section shape and/or cross-sectional area along the length of the flared section 40, or a portion of the length thereof. The shape and size of the flared section 40 generally depends upon the shape of the item being inserted within the flared section 40 and the shape of the tube section 22. The truncated, conical shape of the flared section 40 is preferred since it provides an angularly sloped conical interior surface 44 that smoothly guides the item to the narrow opening 48.

The tube section 22 and the flared section 40 are preferably made of metal, however, other materials can be used such as plastics, composite materials, metal alloys, etc. The tube section 22 and the flared section 40 can be formed of the same material, or can be formed of different materials. Preferably, the interior surface 26 of the tube section 22 and the interior surface 44 of the flared section 40 are smooth to allow the item to slide easily through the main portion 20. The interior surfaces 26 and 44 can be polished and/or coated with a low friction material in order to facilitate the sliding of the item through the main portion 20. In order to facilitate the sliding of the item through the main portion 20, the tube section 22 and the flared section 40 can be formed integrally with one another, for example, by forming the main portion using a mold such that the portion of the main portion 20 where the tube section 22 and the flared section 40 join is smooth. Alternatively, the tube section 22 and the flared section 40 can be integrally formed such that the tube section 22 and the flared section 40 are formed as one continuous conical surface.

The bagging apparatus 10 according to the present invention preferably includes a mounting device 50 configured to mount the apparatus on a stationary structure, such as a table, the ground, a flat surface, or any other suitable structure. The mounting device 50 preferably includes a base 58, and a bracket 52 connecting the base 58 to the main portion 20, such as to the tube section 22 or, alternatively, to the flared section 40. The bracket 52 includes a first end 54 attached to the main portion 20, and a second end 56 attached to the base 58. The bracket 52 can be made fixed or detachable from the main portion 20 and the base 58, and can be constructed to be adjustable such that the height of the main portion 20 off the base 58 can be adjusted or the attachment location on the main portion 20 can be adjusted, if so desired. The mounting device 50 includes a plurality of holes 60 that can be used to detachably fixed the apparatus 10 to the stationary structure using nuts and bolts (not depicted), or alternatively the base 58 can be secured to a table or other surface by a clamp. Alternatively, the base 58 can be constructed of a heavy material that acts as a weight to stabilize and mount the apparatus 10 on a surface without physically attaching the apparatus 10 to the support surface.

The bagging apparatus 10 according to the present invention preferably further includes a receptacle 70 configured to fit over the receptacle receiving portion 32 on the tube section 22. The receptacle 70 can be configured as a bag having an open end 72 and a closed end 74 as depicted in FIGS. 1 and 2, or as a sleeve where end 74 is opened, rather than being closed. The receptacle 70 is shaped and sized dependent upon the shape and size of the item being packaged within the receptacle 70. The preferred embodiment of the receptacle 70 includes a transparent plastic bag having indicia 76 thereon labeling the product, which can be used also as a reference for orienting and aligning the item within the receptacle 70 in order to ensure the final product is aesthetically pleasing to the consumer.

FIG. 3 depicts an alternative embodiment of a bagging apparatus according to the present invention. The alternative embodiment is identical to the embodiment depicted in FIGS. 1 and 2, except as described below. In the alternative embodiment of FIG. 3 the main portion 20 includes a flared section 140 that is formed having a curved interior surface 144 and exterior surface 142. The curved interior surface 144 smoothly joins with the interior surface 26 of the tube section 22.

A method for inserting an item into a receptacle using a bagging apparatus according to the present invention will now be discussed with reference FIGS. 4A through 4D. The bagging apparatus depicted in FIGS. 4A through 4D is identical to the embodiment depicted in FIGS. 1 and 2. The method for inserting an item into a receptacle is advantageous in that it provides a process for easily and neatly inserting an item into a receptacle.

Figure 4A:
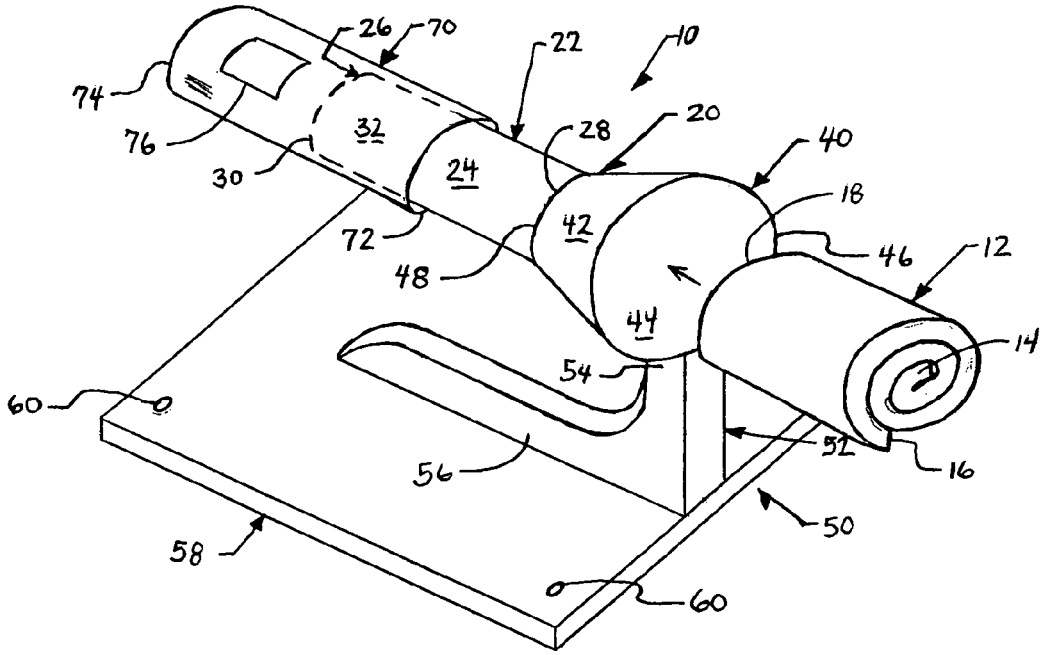
FIGS. 4A through 4D depict a method of bagging an item according to the present invention.

FIG. 4A depicts the bagging apparatus 10 mounted on a stationary support structure, such as a table top using a plurality of bolts and nuts (not depicted). The method of the present invention includes the step of positioning a receptacle 70 over an exterior surface 24 of the tube section adjacent the second opening 30. Preferably, the open end 72 of the receptacle 70 is positioned over the receptacle receiving portion 32 on the tube section 22. The item being inserted within the bagging apparatus 10 can be of any configuration. The item depicted in FIGS. 4A through 4D is an elongated sheet of material 12, such as a sheet of insulation, and the receptacle 70 is a transparent plastic bag.

The sheet of material 12 is rolled prior to insertion into the bagging apparatus 10. The sheet of material 12 depicted in FIG. 4A has been rolled in a counterclockwise direction (as viewed in FIG. 4A) with terminal edge or end 14 being in the interior of the roll and terminal edge or end 16 being on the exterior of the roll. The sheet of material is rolled so that the sheet of material can be inserted within the receptacle. Note, however, that if the rolled sheet of material is inserted directly into the receptacle within the use of the bagging apparatus, the rolled sheet of material be difficult to insert since it is sized to fit snugly into the receptacle. This insertion process would require a single worker both holding open the receptacle and inserting the rolled sheet of material, or two workers acting in unison with one worker holding the receptacle and one worker inserting the rolled sheet of material. Such a process is very labor intensive. Additionally, during such a process a leading end 18 of the rolled sheet of material, especially at and adjacent end 16, would become be bent, frayed and deformed during the insertion process. The resulting packaged product would not be aesthetically pleasing to the consumer as the deformed rolled sheet of material is visible through the transparent plastic bag used as a receptacle. Accordingly, the present invention allows for the rolled sheet of material 12 to be neatly and easily inserted within the receptacle 70.

Figure 4B:
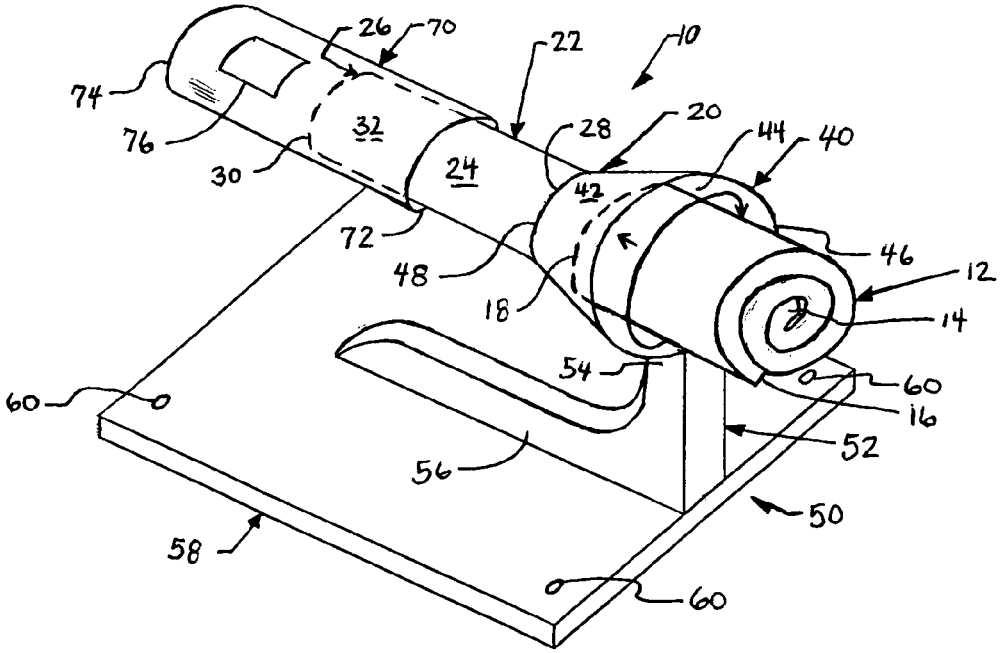

FIG. 4B depicts the rolled sheet of material 12 being inserted within the flared section 40 of the bagging apparatus 10 via the wide opening 46. The interior surface 44 of the flared section 40 guides the rolled sheet of material 12 towards the narrow opening 48. The rolled sheet of material 12 can be inserted within the flared section 40 without rotation or with rotation. Preferably the rolled sheet of material 12 is inserted within the flared section while rotating the sheet of material 12 in a clockwise direction as viewed in FIG. 4B. By rotating the rolled sheet of material 12 in a direction opposite the direction that rolled sheet of material is rolled, the terminal edge 16 of the rolled sheet of material 12 is maintained flat against the exterior surface of the rolled sheet of material 12. By using this method, the final product will be aesthetically pleasing to a consumer, since the rolled sheet of material 12 will be neatly inserted into the receptacle 70 without any frayed or deformed edges.

Figure 4C:
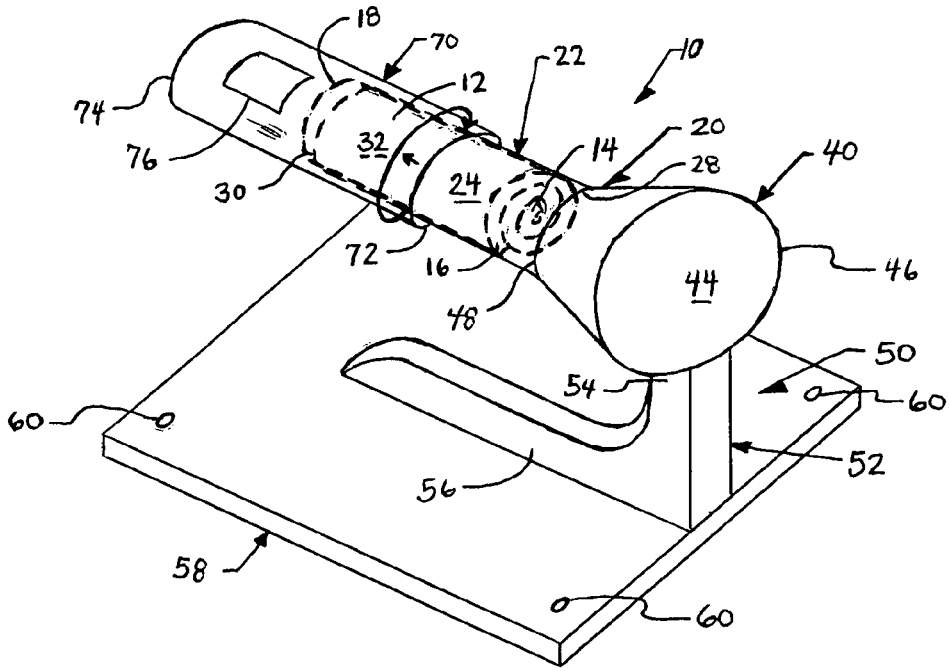
Figure 4D:
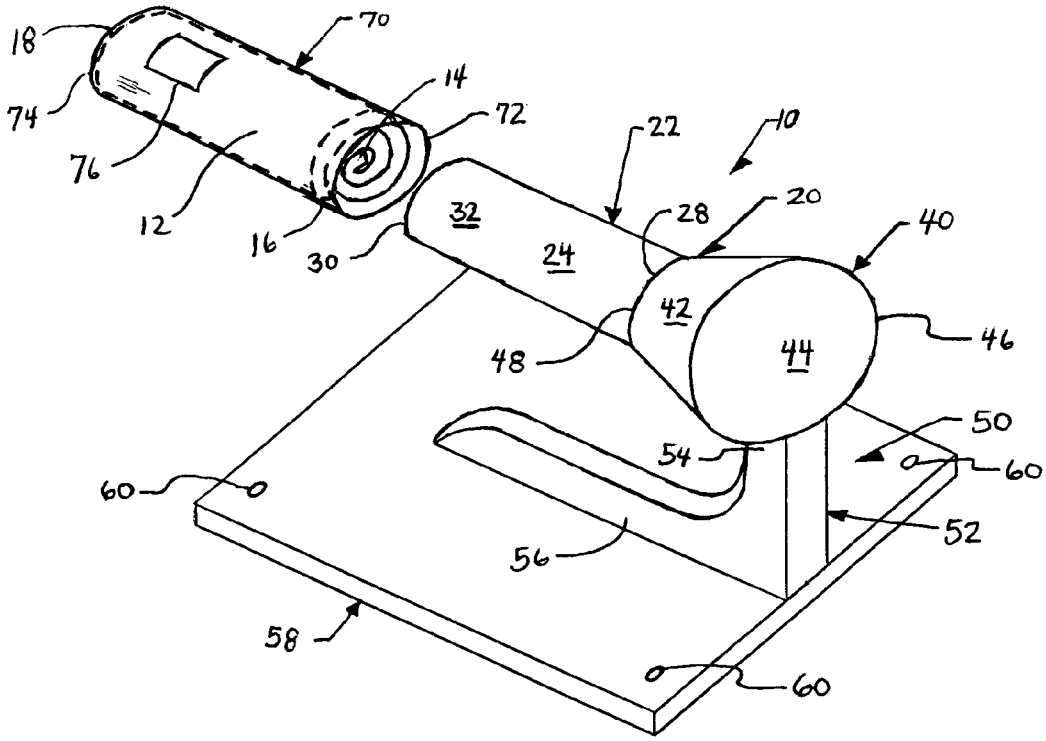

FIG. 4C depicts the rolled sheet of material 12 being slid through the narrow opening 48 of the flared section 40, through the tube section 22, and within the receptacle 70. The rolled sheet of material 12 can be slid without rotation or with rotation. Preferably the rolled sheet of material 12 is slid while rotating the sheet of material 12 in a clockwise direction as viewed in FIG. 4C. FIG. 4D depicts the rolled sheet of material 12 fully inserted within the receptacle 70. In order to produce a product that is aesthetically pleasing to a consumer, the method further includes the step of aligning the rolled sheet of material 12 at a predetermined orientation within the receptacle 70. This can be carried out by either rotating the rolled sheet of material 12 while it is in the tube section 22 or while it is in the receptacle 70. The rolled sheet of material 12 can be oriented at a predetermined orientation, for example, by orienting the end 16 at a predetermined position with respect to the indicia 76 on the receptacle 70. For example, by placing the end 16 at the rear of the receptacle 70, the consumer will view a smooth surface of the rolled sheet of material 12 on the front of the receptacle 70 where the labeling indicia is present. Once the rolled sheet of material 12 is positioned within the receptacle 70, the open end 72 can be sealed to form the final product.

Numerous variations of the present invention are possible in light of the above teachings. It is therefore to be understood that within the scope of the appended claims, the present invention can be practiced other than as specifically described herein.

What is claimed is:

1. A method for inserting an item into a receptacle using an apparatus having a hollow cylindrical tube section having a first opening and a second opening and a hollow flared section having a narrow opening and a wide opening, the narrow opening being connected to the first opening, said method comprising the steps of:

positioning a receptacle over an exterior surface of the cylindrical tube section adjacent the second opening;

inserting the item within the flared section via the wide opening; and sliding the item through the narrow opening of the flared section, through the cylindrical tube section, and within the receptacle, wherein the item is a rolled, elongated sheet of material that is rolled such that a terminal edge of the elongated sheet is located on an exterior surface of the rolled item, and wherein said method further comprises the step of rotating the item as the item is inserted within the flared section, where the item is rotated in a direction opposite a direction of rolling of the item such that the terminal edge of the elongated sheet is maintained flat against the exterior surface of the rolled item, where the direction of rolling of the item is defined as a direction of outward spiraling from an end provided at a center of the rolled item.

2. A method for inserting an item that is a rolled, elongated sheet of material into a receptacle using an apparatus having a hollow cylindrical tube section having a first opening and a second opening and a hollow flared section having a narrow opening and a wide opening, the narrow opening being connected to the first opening, said method comprising the steps of:

positioning a receptacle over an exterior surface of the cylindrical tube section adjacent the second opening;

inserting the item within the flared section via the wide opening; and sliding the item through the narrow opening of the flared section, through the cylindrical tube section, and within the receptacle, wherein said method further comprises the step of rotating the item as the item is inserted within the flared section.

3. A method for inserting an item that is a rolled, elongated sheet of material into a receptacle using an apparatus having a hollow cylindrical tube section having a first opening and a second opening and a hollow flared section having a narrow opening and a wide opening, the narrow opening being connected to the first opening, said method comprising the steps of:

positioning a receptacle over an exterior surface of the cylindrical tube section adjacent the second opening;

inserting the item within the flared section via the wide opening; and sliding the item through the narrow opening of the flared section, through the cylindrical tube section, and within the receptacle, wherein said method further comprises the step of rotating the item as the item is slid through the cylindrical tube section.

4. The method according to claim 1, wherein said method further comprises the step of aligning the item at a predetermined orientation within the receptacle.

5. The method according to claim 1, wherein said method further comprises the step of mounting said apparatus to a stationary structure.

6. The method according to claim 1, wherein the receptacle is a bag.

7. The method according to claim 1, wherein the receptacle is a sleeve.

* * * * *